US009357856B2

(12) United States Patent
Szpak et al.

(10) Patent No.: US 9,357,856 B2
(45) Date of Patent: Jun. 7, 2016

(54) LATCHING SYSTEM FOR A MERCHANDISING APPARATUS

(71) Applicants: Gerald Matthew Szpak, Brecksville, OH (US); Gregory M. Bird, Solon, OH (US); Shane Obitts, Elyria, OH (US); Matthew Grubbs, Union, KY (US)

(72) Inventors: Gerald Matthew Szpak, Brecksville, OH (US); Gregory M. Bird, Solon, OH (US); Shane Obitts, Elyria, OH (US); Matthew Grubbs, Union, KY (US)

(73) Assignee: Fasteners For Retail, Inc., Twinsburg, OH (US)

( * ) Notice: Subject to any disclaimer, the term of this patent is extended or adjusted under 35 U.S.C. 154(b) by 0 days.

(21) Appl. No.: 14/207,782

(22) Filed: Mar. 13, 2014

(65) Prior Publication Data

US 2014/0190917 A1 Jul. 10, 2014

Related U.S. Application Data

(63) Continuation-in-part of application No. 13/957,962, filed on Aug. 2, 2013, and a continuation-in-part of application No. 13/957,986, filed on Aug. 2, 2013.

(60) Provisional application No. 61/679,419, filed on Aug. 3, 2012, provisional application No. 61/808,000, filed on Apr. 3, 2013, provisional application No. 61/808,010, filed on Apr. 3, 2013.

(51) Int. Cl.
*A47F 1/04* (2006.01)
*A47F 7/00* (2006.01)
(Continued)

(52) U.S. Cl.
CPC ..... *A47F 1/04* (2013.01); *A47B 96/024* (2013.01); *A47B 96/025* (2013.01); *A47F 1/12* (2013.01); *A47F 5/0093* (2013.01)

(58) Field of Classification Search
CPC ..... A47F 1/12; A47F 1/126; A47F 5/0093; A47F 5/005; A47B 96/027; A47B 96/25
USPC ..... 211/187, 59.3, 90.02, 134, 153; 108/108
See application file for complete search history.

(56) References Cited

U.S. PATENT DOCUMENTS 860,770 A * 7/1907 Tait ..... E05B 65/0864 292/175
888,754 A * 5/1908 Schuff ..... A47N 23/046 108/146

(Continued)

FOREIGN PATENT DOCUMENTS

CA 2 725 928 A1 6/2011
EP 0 004 921 A1 10/1979

(Continued)

OTHER PUBLICATIONS

FFR-DSI Yellow Pages 2010 Product Catalog, cover page, pp. 231, 241, and 246.

*Primary Examiner* — Joshua Rodden
*Assistant Examiner* — Kimberley S Wright
(74) *Attorney, Agent, or Firm* — Fay Sharpe LLP

(57) ABSTRACT

A latching system for a gravity fed merchandising apparatus includes a shelf slidably mounted between a first and a second side bracket, the shelf being adapted to move between a vending position and a stocking position. A first latch member is operably mounted to one of the shelf and the first side bracket and a second latch member is operably mounted to one of the shelf and the second side bracket. The first and second latch members are located adjacent opposed side edges of the shelf. Each of the first and second latch members is resiliently biased to an extended position. An actuating device is provided for moving the first and second latch members to a respective retracted position allowing the shelf to slide from the vending position to the stocking position.

17 Claims, 18 Drawing Sheets

(51) Int. Cl.

| | |
|---|---|
| ***A47F 5/00*** | (2006.01) |
| ***A47B 96/02*** | (2006.01) |
| ***A47F 1/12*** | (2006.01) |

(56) References Cited

U.S. PATENT DOCUMENTS

| | | | | | |
|---|---|---|---|---|---|
| 1,877,050 | A | | 9/1932 | Ray | |
| 2,446,788 | A | | 8/1948 | Rifkin | |
| 2,460,396 | A | | 2/1949 | Rifkin | |
| 2,480,339 | A | | 8/1949 | Rifkin | |
| 2,522,896 | A | | 9/1950 | Rifkin | |
| 2,556,612 | A | * | 6/1951 | Buntin | 312/334.12 |
| 3,358,956 | A | * | 12/1967 | Thornton | 248/243 |
| 3,814,492 | A | * | 6/1974 | Jacobs | 312/273 |
| 3,885,846 | A | * | 5/1975 | Chuang et al. | 312/306 |
| 3,923,159 | A | | 12/1975 | Taylor et al. | |
| 4,482,066 | A | * | 11/1984 | Dykstra | 211/151 |
| 4,640,560 | A | | 2/1987 | Blum | |
| 4,736,689 | A | * | 4/1988 | Stanko | 108/5 |
| 5,390,802 | A | * | 2/1995 | Pappagallo et al. | 211/59.3 |
| 5,417,333 | A | | 5/1995 | Flum | |
| 5,542,552 | A | | 8/1996 | Yablans et al. | |
| 5,673,801 | A | * | 10/1997 | Markson | 211/59.3 |
| 5,806,689 | A | | 9/1998 | Mays et al. | |
| 6,021,908 | A | * | 2/2000 | Mathews | 211/90.02 |
| 6,142,317 | A | | 11/2000 | Merl | |
| 6,253,954 | B1 | | 7/2001 | Yasaka | |
| 6,428,123 | B1 | | 8/2002 | Lucht et al. | |
| 6,513,667 | B2 | | 2/2003 | Battaglia et al. | |
| 7,040,494 | B2 | * | 5/2006 | Harper | 211/90.02 |
| 7,124,898 | B2 | | 10/2006 | Richter et al. | |
| 7,150,365 | B2 | | 12/2006 | Hardy et al. | |
| 7,258,317 | B1 | * | 8/2007 | Nagel | 248/244 |
| 7,641,072 | B1 | | 1/2010 | Vlastakis et al. | |
| 7,690,519 | B2 | | 4/2010 | Kahl et al. | |
| 7,823,734 | B2 | | 11/2010 | Hardy | |
| 8,020,714 | B2 | * | 9/2011 | Miller et al. | 211/134 |
| 8,056,734 | B2 | | 11/2011 | Menz et al. | |
| 8,152,006 | B2 | | 4/2012 | Wamsley et al. | |
| 8,333,448 | B2 | * | 12/2012 | Yoon et al. | 312/408 |
| 8,413,825 | B2 | * | 4/2013 | Spizman et al. | 211/184 |
| 8,469,205 | B1 | | 6/2013 | Hardy | |
| 8,596,443 | B2 | * | 12/2013 | Brugmann | 193/35 TE |
| 8,800,785 | B2 | * | 8/2014 | Kalafut | 211/7 |
| 2004/0140279 | A1 | | 7/2004 | Mueller et al. | |
| 2004/0182804 | A1 | * | 9/2004 | Harper | 211/90.02 |
| 2004/0182805 | A1 | * | 9/2004 | Harper | 211/90.02 |
| 2006/0207950 | A1 | | 9/2006 | Kiehnau et al. | |
| 2007/0170127 | A1 | | 7/2007 | Johnson | |
| 2008/0035589 | A1 | * | 2/2008 | Rasmussen | A47F 1/126 211/59.3 |
| 2008/0121146 | A1 | * | 5/2008 | Burns et al. | 108/23 |
| 2009/0107938 | A1 | * | 4/2009 | Miller et al. | 211/133.6 |
| 2011/0100942 | A1 | * | 5/2011 | Spizman | A47B 57/045 211/150 |
| 2012/0006771 | A1 | * | 1/2012 | Miller et al. | 211/59.2 |
| 2012/0103922 | A1 | | 5/2012 | Bird et al. | |
| 2012/0211327 | A1 | * | 8/2012 | Brugmann | 193/35 R |
| 2014/0034590 | A1 | * | 2/2014 | Szpak et al. | 211/59.2 |
| 2014/0034591 | A1 | * | 2/2014 | Szpak et al. | 211/59.2 |
| 2014/0091696 | A1 | * | 4/2014 | Welker et al. | 312/408 |
| 2014/0190917 | A1 | * | 7/2014 | Szpak et al. | 211/134 |
| 2014/0305889 | A1 | * | 10/2014 | Vogler et al. | 211/59.3 |
| 2014/0305891 | A1 | * | 10/2014 | Vogler et al. | 211/59.3 |

FOREIGN PATENT DOCUMENTS

| | | | | |
|---|---|---|---|---|
| EP | 0 568 396 | A1 | 11/1993 | |
| NL | 9301698 | * | 5/1995 | A47F 1/121 |

* cited by examiner

LATCHING SYSTEM FOR A MERCHANDISING APPARATUS

The instant application is a continuation-in-part application of U.S. Ser. No. 13/957,962 which was filed on Aug. 2, 2013. That application in turn is a full utility application of and claims priority from U.S. Provisional Application Ser. Nos. 61/679,419 filed on Aug. 3, 2012 and 61/808,000 filed on Apr. 3, 2013. The instant application is also a continuation-in-part of U.S. Ser. No. 13/957,986 which was filed on Aug. 2, 2013. That application in turn is a full utility application of and claims priority from U.S. Provisional Application Ser. Nos. 61/679,419 filed on Aug. 3, 2012 and 61/808,010 filed on Apr. 3, 2013.

BACKGROUND

The present disclosure concerns a product dispensing system employed in point of sale merchandising. It particularly pertains to shelving systems which feed containers forward. More specifically, it relates to modular gravity fed shelving systems for fragile products, such as individual thin wall containers of, for example, a refrigerated dairy product.

Many products of this type are available, including yogurt, cottage cheese, cream cheese, sour cream and the like. Such products are typically sold in individual cups or containers in supermarkets and the like. Dairy product containers of this kind normally have planar bases and planar tops so that they can be stacked atop each other. Traditionally, such dairy products are sold in refrigerator cases, including generally horizontal shelves upon which the dairy products are held.

Gravity feed systems are known to move products towards the front of display or storage cases. While it is now known to feed dairy products such as yogurt by gravity towards the front end of a refrigerated display case, the currently known retainers positioned at the front end of such display trays or shelves are not optimal. In addition, conventional display shelving systems require more vertical spacing between adjacent shelves in order to allow restocking of the dairy products on the shelves because of clearance issues. Specifically, the merchant cannot allow products on a shelf which is pulled out for restocking to contact the shelf immediately above it. This mandates a minimum shelf spacing in a storage case. It is a particular problem for slide out shelving which conventionally needs to be tilted as it is slid forward to the restocking position.

Further, current shelving designs do not allow for a secondary shelf to be placed atop the primary shelf to provide additional displays of product. Such a design is useful for providing more product selection without the need to replace the entire shelving system. It would be desirable to provide an adjustable mounting structure for shelving systems so that the shelves can be accommodated in the supports or stanchion designs of several different stanchion manufacturers which each have a somewhat different design for their respective stanchions or supports. It would also be desirable to provide a better locking system for pull out shelving to retain a slide out shelf in the use position. Thus, a need exists for a shelving system which overcomes the deficiencies of prior shelving systems as outlined above.

BRIEF DESCRIPTION OF THE DISCLOSURE

In one embodiment of the present disclosure, a sliding shelf latching system comprises a shelf movably mounted on a pair of brackets the shelf being movable between a vending position and a stocking position. A first latch housing is mounted to the shelf adjacent a first side edge of the shelf. A second latch housing is mounted to the shelf adjacent a second side edge of the shelf. A first latch member is mounted in the first latch housing, wherein the first latch member is resiliently biased into an extended position. A second latch member is mounted in the second latch housing, wherein the second latch member is resiliently biased into an extended position. A first cable connects the first and second latch members to each other. The first cable is adapted to move the first and second latch members into respective retracted positions and allow the shelf to be moved from the vending position to the stocking position.

In accordance with another embodiment of the present disclosure, a sliding shelf latching system comprises a shelf including a first side edge, a second side edge, a top surface and a bottom surface. The shelf is slidably mounted between a pair of side brackets and is movable between a vending position and a stocking position. A first latch assembly is mounted to the shelf bottom surface adjacent a first side edge of the shelf. The first latch assembly includes a first latch housing and a first latch member resiliently biased to an extended position in relation to the first latch housing. A second latch assembly is mounted to the shelf bottom surface adjacent the second side edge of the shelf, the second latch assembly including a second latch housing and a second latch member resiliently biased to an extended position in relation to the second latch housing. A first cable is connected to the first and second latch members wherein the first cable is adapted to retract the first and second latch members in order to allow the shelf to be moved from the vending position to the stocking position.

According to still another embodiment of the present disclosure, a latching system for a gravity fed merchandising apparatus comprises a shelf slidably mounted between a first and a second side bracket. The shelf is adapted to move between a vending position and a stocking position. A first latch member is operably mounted to one of the shelf and the first side bracket and a second latch member is operably mounted to one of the shelf and the second side bracket. The first and second latch members are located adjacent opposed side edges of the shelf. The first and second latch members are each resiliently biased to an extended position. An actuating device is provided for moving the first and second latch members to a respective retracted position allowing the shelf to slide from the vending position to the stocking position. The actuating device includes a cable connecting the first and second latch members to each other.

BRIEF DESCRIPTION OF THE DRAWINGS

The present disclosure may take physical form in certain parts and arrangements of parts, several embodiments of which will be described in detail in this specification and illustrated in the accompanying drawings which form a part hereof and wherein.

DETAILED DESCRIPTION

It should be understood that the description and drawings herein are merely illustrative and that various modifications and changes can be made in the structures disclosed without the departing from the scope of the present disclosure. It should also be appreciated that the various identified components of the product merchandising systems discussed herein are merely terms of art and that these may vary from one manufacturer to another. Such terms should not be deemed to limit the present disclosure.

Figure 1:
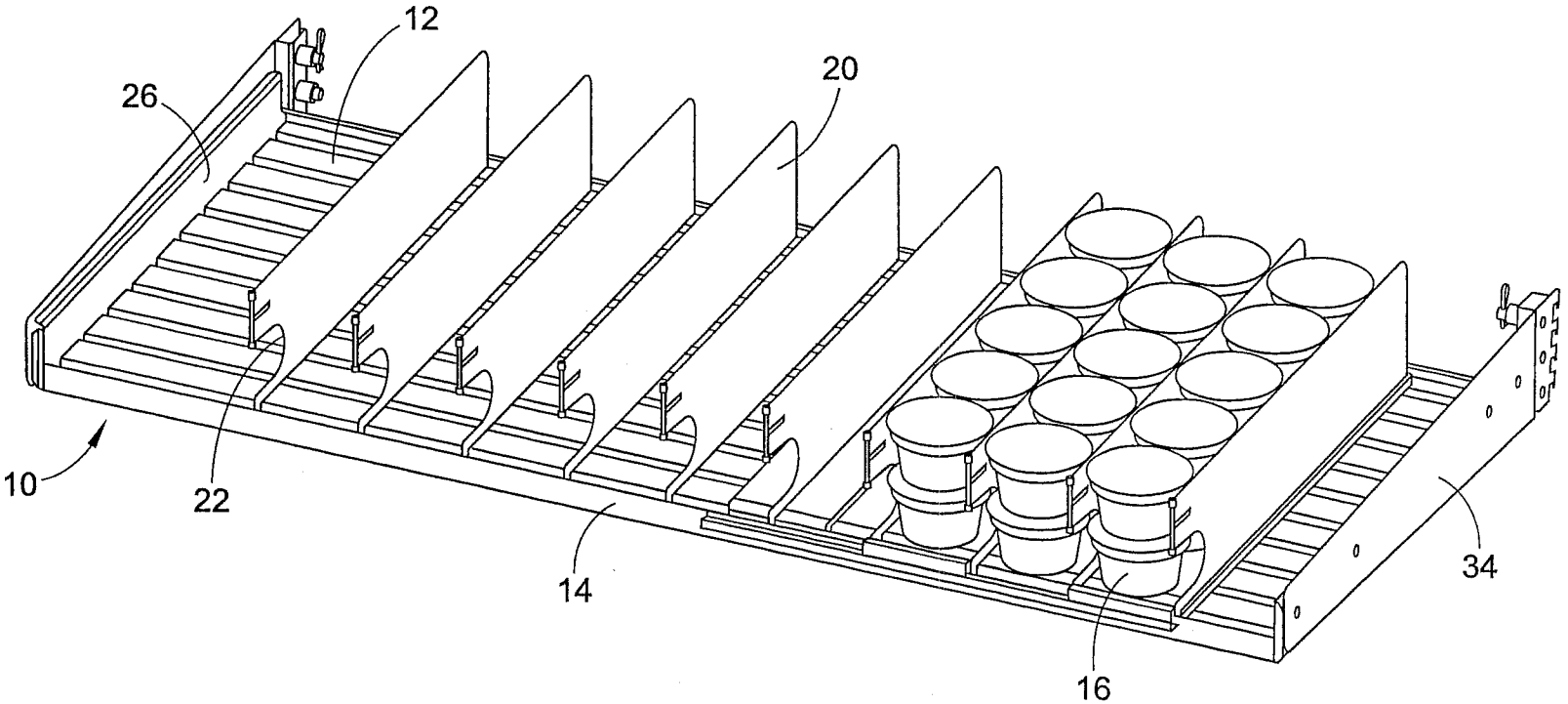
FIG. 1 is a perspective view of a shelving system according to a first embodiment of the present disclosure in a retracted position.

With reference now to FIG. 1, a first embodiment of a shelving system according to the instant disclosure includes a merchandising shelf 10. In the embodiment disclosed, the shelf includes a base 12 on which are supported a plurality of roller tracks 14. The roller tracks can be of the type disclosed in U.S. Pat. No. 6,089,385 which issued on Jul. 18, 2000 and is entitled "Roller Type Commodity Stand." The disclosure of the '385 patent is incorporated hereinto by reference in its entirety. Other means for moving the packages or containers forward on the shelf include motion mats or any known non-friction material.

Supported on the roller track 14 can be a container 16 or a stacked set of containers. The containers can be, for example, dairy product containers. It is well known that such containers can hold sour cream, cottage cheese, yogurt, cream cheese and the like. The containers generally have planar bottom and top surfaces so that they can be stacked atop each other as is illustrated in FIG. 1. A gravity fed system is illustrated in which the containers will move towards the front end of the shelf because the front end is located at a lower elevation than the rear end of the shelf. Not very visible in FIG. 1 is a front barrier which prevents the container 16 from falling off the front end of the shelf. Such a barrier can be a conventional fence, as is known in the art.

Separating the several containers 16 into columns are respective dividers 20. The dividers can be mounted either to the roller tracks 14 or directly to the shelf base 12, depending on the design of the roller tracks and of the shelf base. It should be appreciated that the dividers 20 are of sufficient height so as to divide a stacked set of containers into columns. Located at a front end of each divider is a cutout 22. The purpose for the cutout is to allow finger access by a customer in order to grasp a container which the customer wishes to remove from the shelf.

Figure 2:
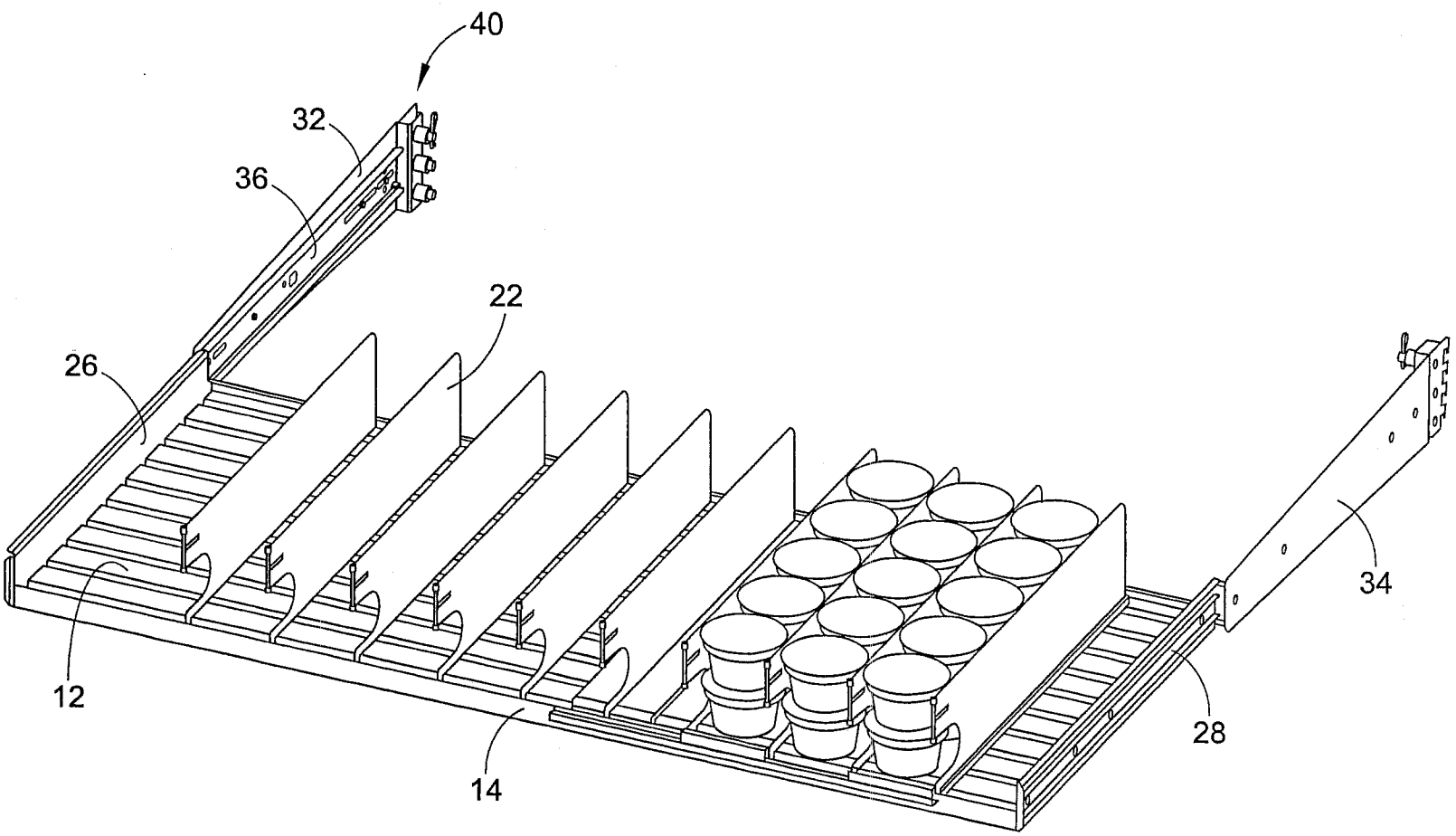
FIG. 2 is a perspective view of the shelving system of FIG. 1 shown in an extended position.
Figure 5:
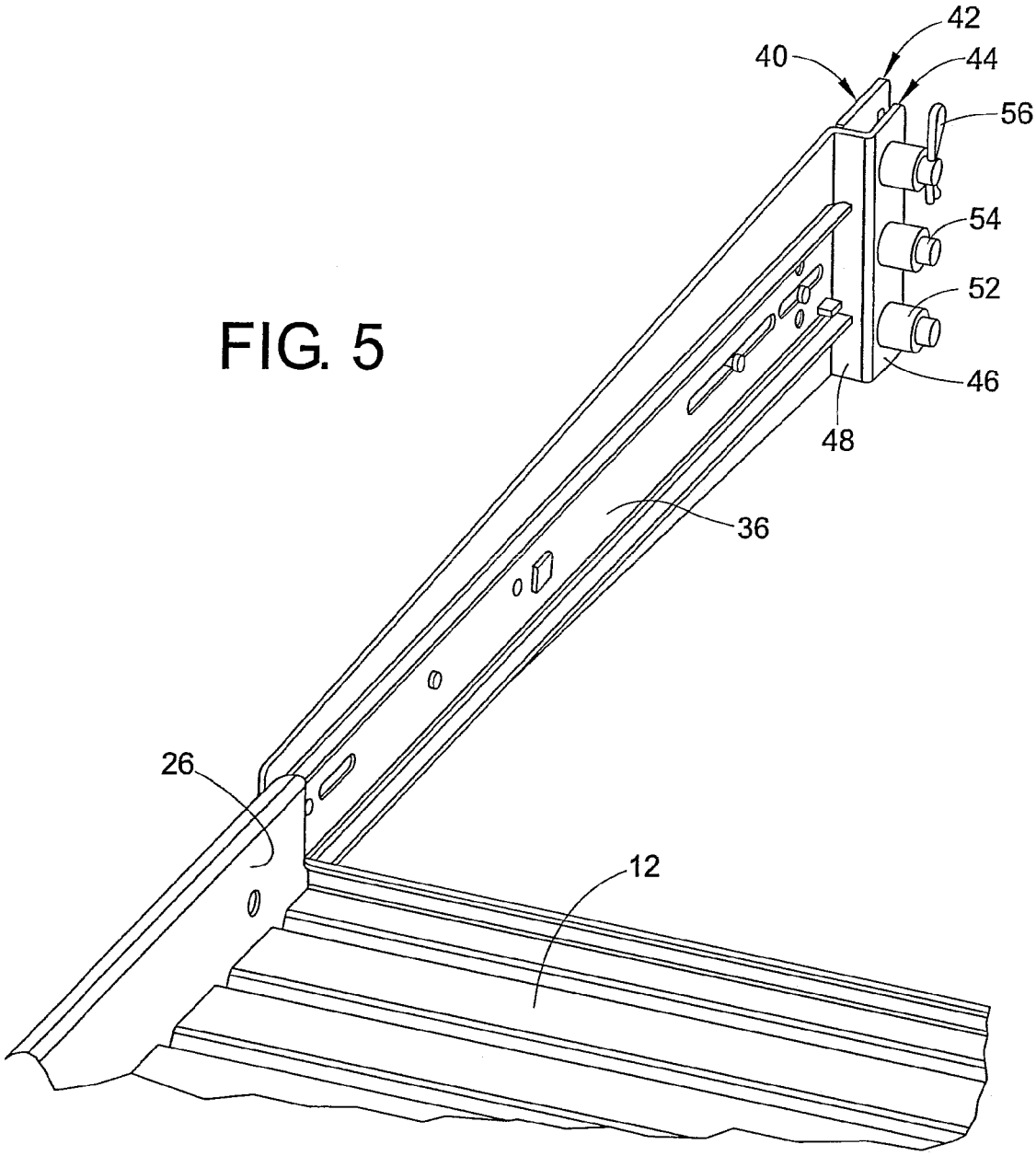
FIG. 5 is a greatly enlarged perspective view of a portion of the shelving system of FIG. 2.
Figure 12:
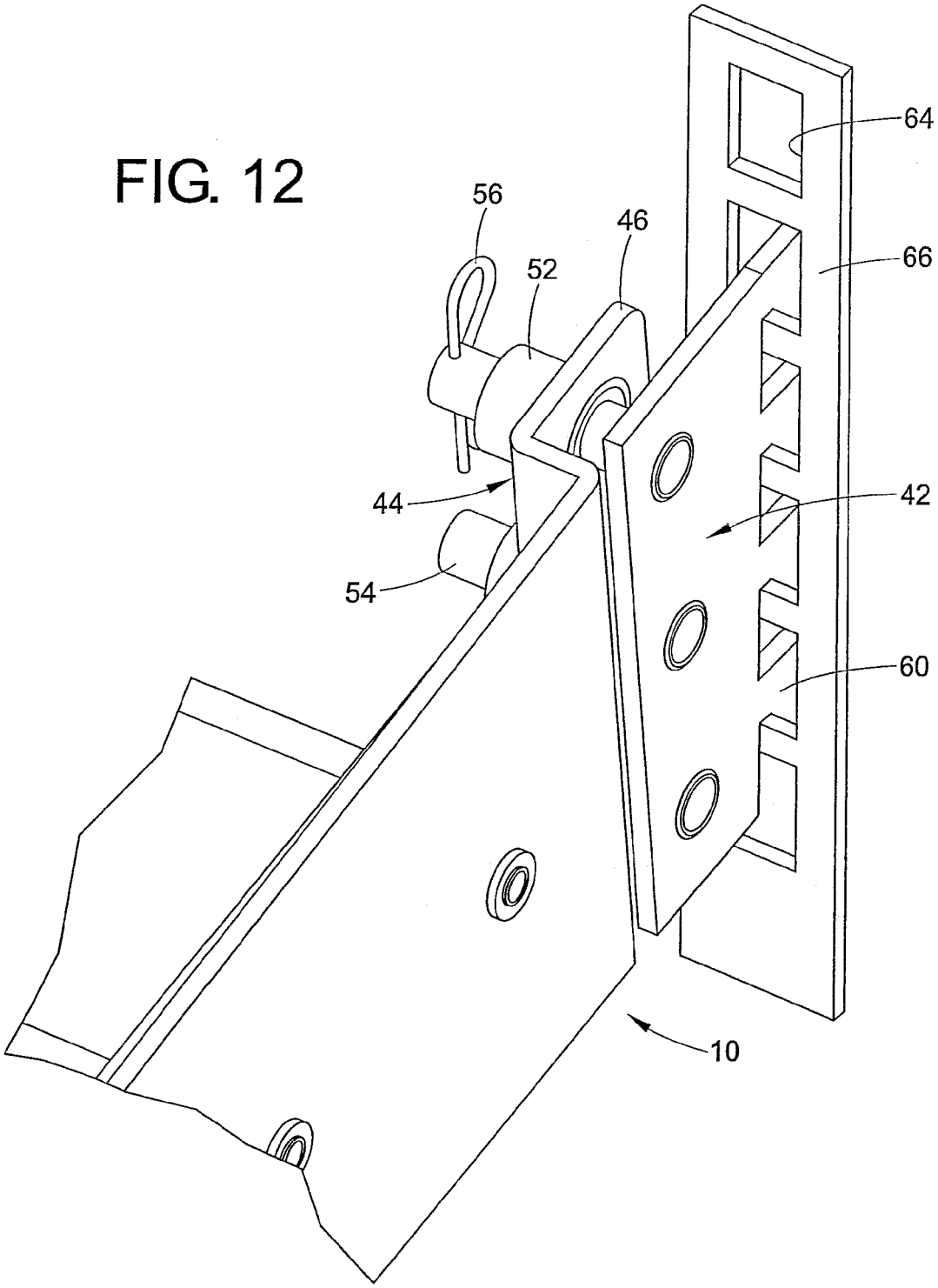
FIG. 12 is an enlarged perspective view of a mounting portion of the shelving system illustrated in FIG. 1.

With reference now also to FIG. 2, it can be appreciated that the shelf 10 is of a pull out nature. To this end, the shelf includes a pair of side walls 26 and 28 attached or connected to the base wall 12. The shelf, via the side walls 26 and 28, is slidably mounted in respective first and second brackets 32 and 34 of the shelving assembly. To this end, respective slides 36 (only one of which is visible in FIG. 2) are provided. Located at a rear end of the respective brackets is a mounting portion 40. Since the two mounting portions are mirror images of each other, only one of the mounting portions will be discussed in detail herein. With reference now to FIGS. 5 and 12, the mounting portion 40 includes a first member 42 and spaced therefrom and extending generally parallel thereto a second member 44. The second member 44 is integral with the bracket and includes a first wall 46 as well as a connecting wall 48 for connecting the first wall to the remainder of the bracket. A somewhat L-shaped design is disclosed for the second member. Mounted on the first wall 46 is at least one sleeve 52. In this embodiment, three such sleeves are shown in a vertically spaced alignment. Slidably mounted in each sleeve 52 is a pin or connecting member 54 which is fastened to the first member 42. Extending through the pin 54 is an aperture (not visible) which can selectively accommodate a cotter pin 56 to hold the pin in place in the sleeve 52.

Figure 8:
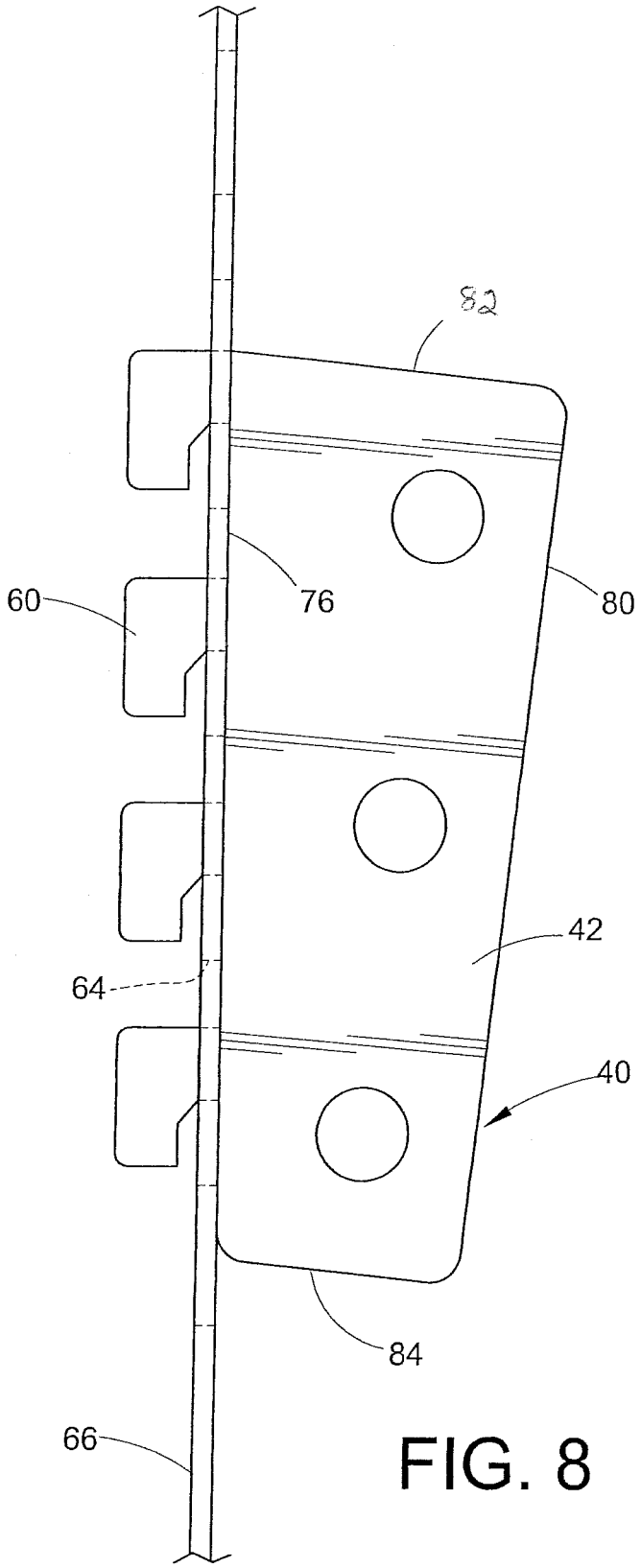
FIG. 8 is a greatly enlarged side elevational view of a bracket of the shelving system of FIG. 1 as mounted on a support.
Figure 9:
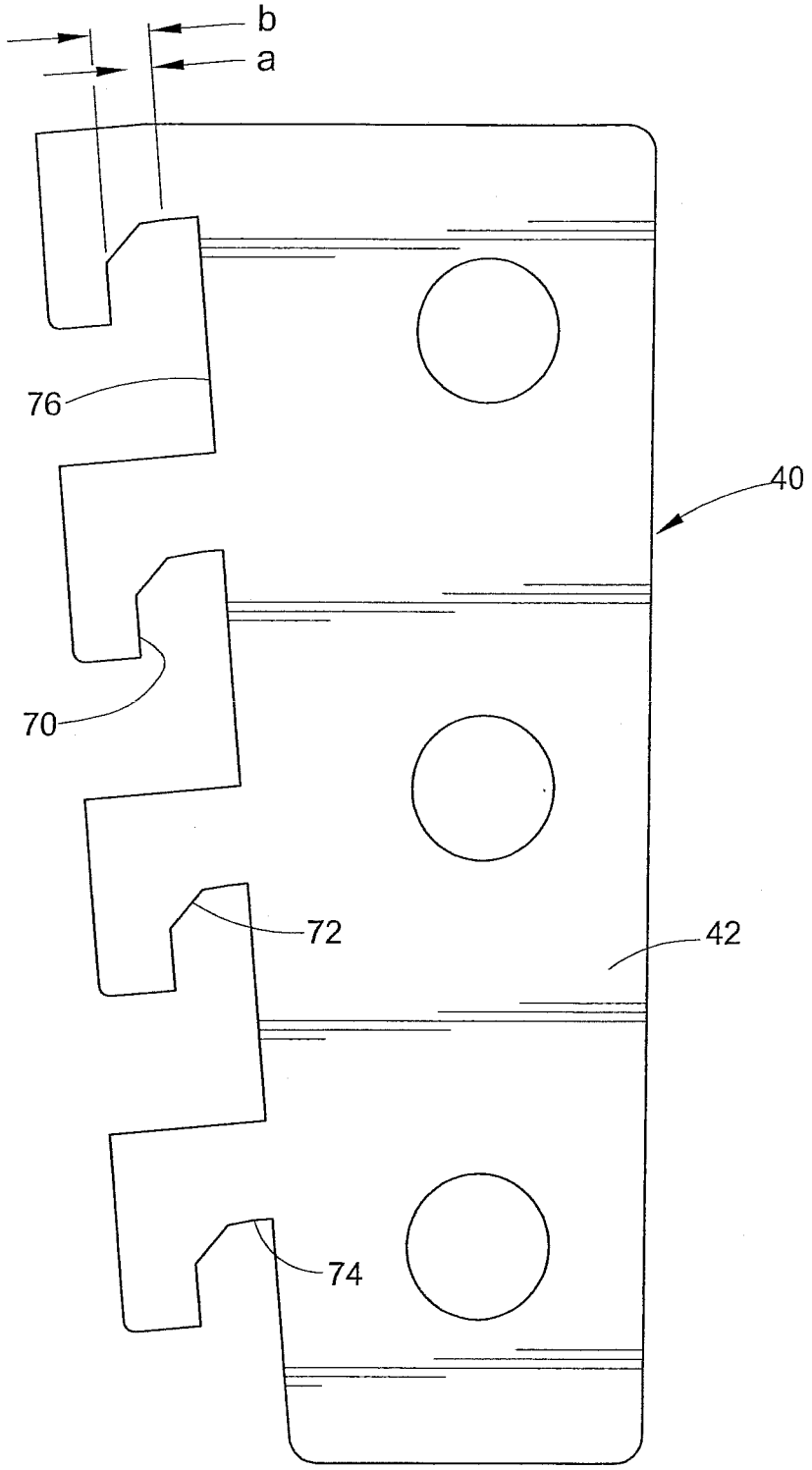
FIG. 9 is an enlarged side elevational view of a bracket of FIG. 8.

With reference now to FIG. 8, the mounting portion 40 includes a plurality of vertically spaced teeth 60 which are designed to protrude through respective apertures 64 defined in a support, standard or stanchion 66 as is well known in the art. There are a number of support manufacturers which each have a somewhat different design for their respective supports. With reference now to FIG. 9, the instant mounting portion is meant to accommodate the support or stanchion designs of several such manufacturers. To this end, the plurality of teeth 60 each include a first wall section 70, a second wall section 72 and a third wall section 74. The wall sections are so oriented that the first section 70 extends generally vertically and is aligned with and spaced from a rear wall 76 of the mounting portion. The second section 72 is oriented at an angle of approximately 45 degrees to the orientation of the first wall section 70. The third wall section 74 is oriented generally perpendicular to the first wall section 70. In this way, a support material width of a (about 0.08 inches) is accommodated by the third wall section 74, whereas a width of b (about 0.180 inches) can be accommodated between the first wall section 70 and the rear wall of the bracket 76. Thus, varying thicknesses of material in the supports or stanchions of the several manufacturers can be accommodated by the mounting portion 40 disclosed herein.

With this arrangement, and with reference again to FIG. 12, the first member 42 can be mounted to the support or standard 66 and the shelf 10 is slid onto the first member 42 via the interengagement of the several pins 54 with the sleeves 52. The shelf is held in place on the first member by use of the cotter pins 56. In one embodiment, three sleeves 52 and three pins 54 are employed. Of course, a variety of other designs is also contemplated.

Figure 10:
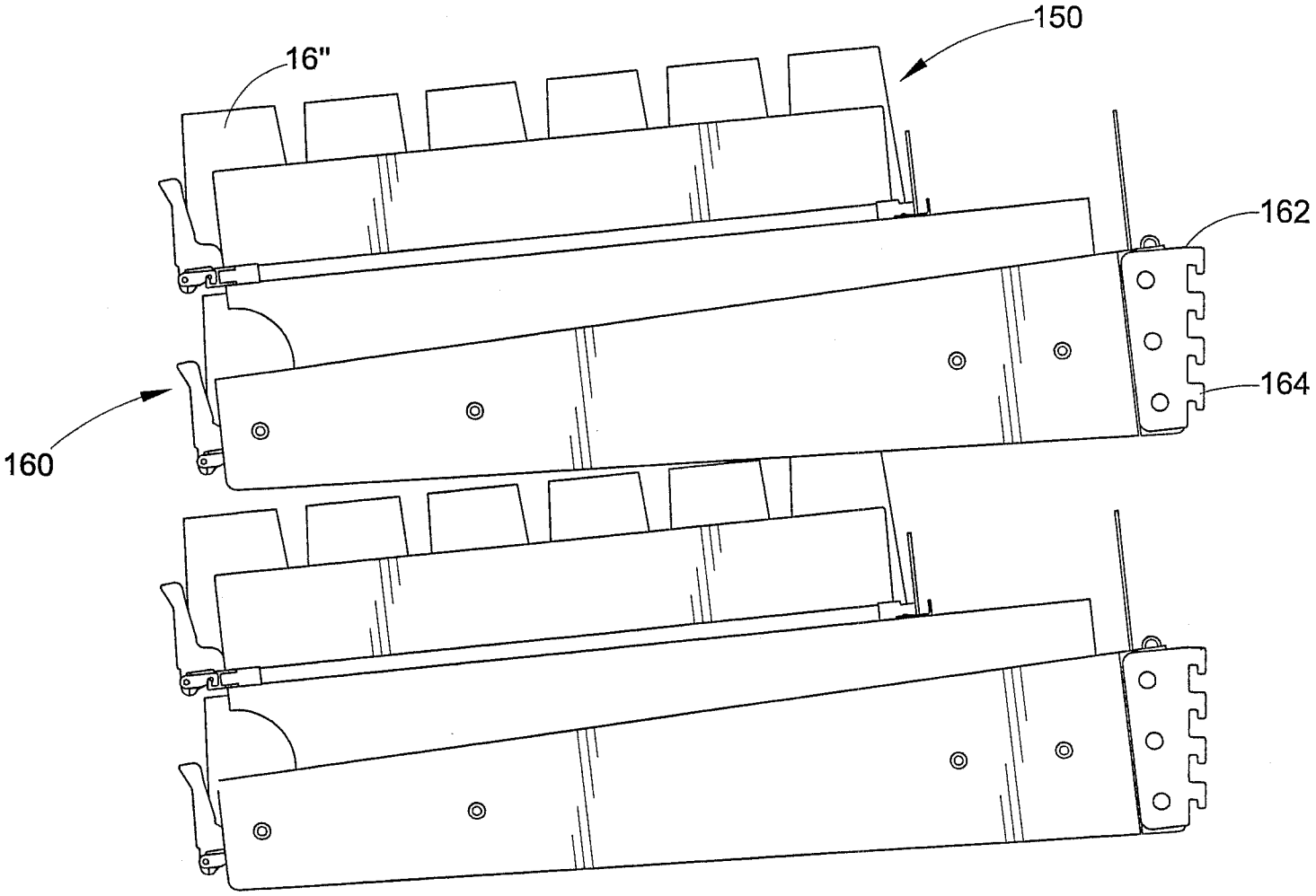
FIG. 10 is a side elevational view of a shelving system employing the second embodiment illustrated in FIG. 3.

With reference now again to FIG. 8, in addition to the back wall 76, the mounting portion also includes a front wall 80, a top wall 82 and a bottom wall 84. It can be seen that the top wall 82 is wider than is the bottom wall 84 so that the mounting portion 40 is angled downwardly somewhat in relation to a horizontal plane. As a result, so is the shelf attached to the mounting portion. As best seen in FIG. 10, the shelving arrangement angles downwardly so as to provide a gravity feed to the containers held on the shelf.

The stanchions of various manufacturers, such as Hussman, Hill-Phoenix and Kysor-Warren vary somewhat, not only in the thickness of the metal used in the supports or stanchions or uprights, but also in the longitudinal spacing between an adjacent pair of such supports to which a shelf is mounted. In order to accommodate such spacing variations, the instant shelving assembly provides a design in which the mounting portion 40 includes the first member 42 which holds the several pins 54 and a second member 44 defined by the wall sections 46 and 48, which hold the sleeves or collars 52 held on the wall section 46. As best seen in FIG. 12, the pins 54 protrude through the sleeves 52 and are held in place via the cotter pins 56. See also FIG. 5. Variations in the spacing between adjacent supports can be accommodated by suitable movement of the second member 44 in relation to the first member 42. The shelf 10 can thus be employed with the supports of a variety of manufacturers making the disclosed shelf design nearly universal.

Figure 6:
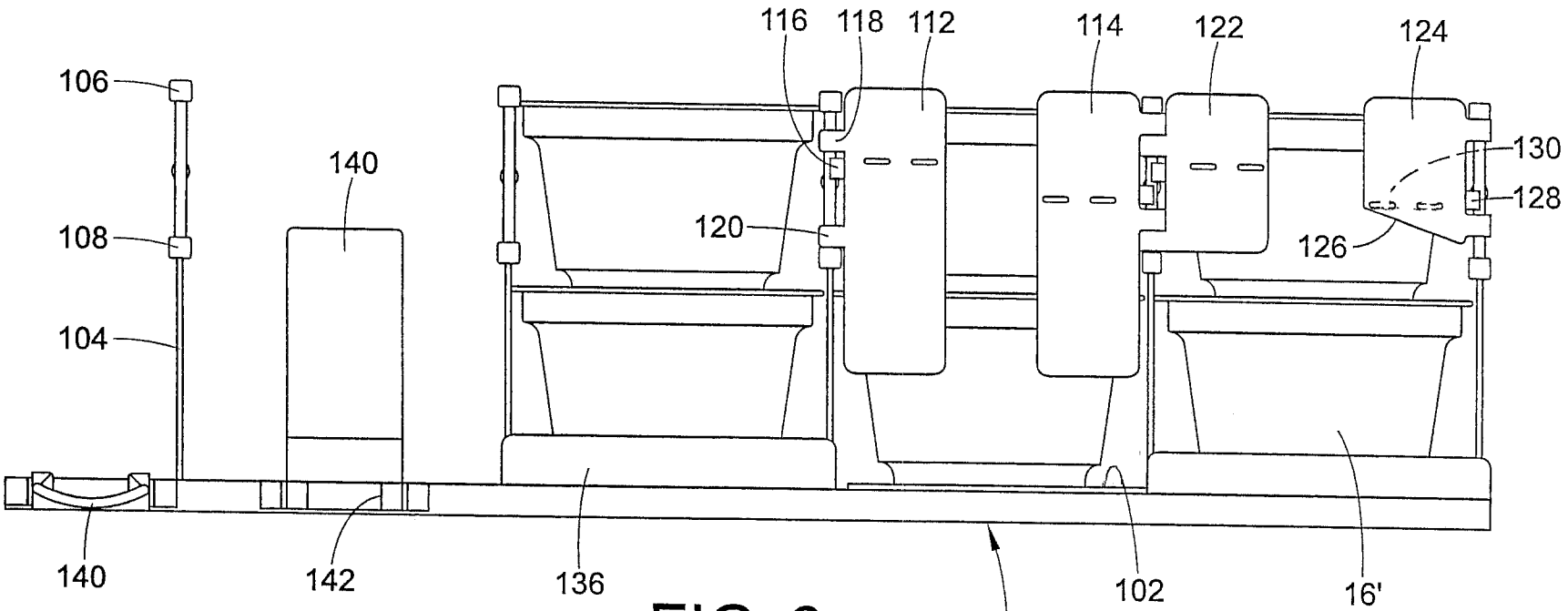
FIG. 6 is a front elevational view of a portion of a shelving system according to a third embodiment of the present disclosure.

With reference now to FIG. 6, another shelf 100 is there illustrated. The shelf includes a base 102 which supports a plurality of spaced dividers 104. In this embodiment, each divider includes a first protrusion 106 which can be located on the upper end of the divider and a second protrusion 108 which is spaced from the first protrusion. This embodiment employs barriers. More specifically, first and second barriers 112 and 114 are mounted to respective dividers. The barriers are spring loaded, such as by a spring 116, which can be a coil spring, to a neutral position. In order to mount the barriers to the dividers, the barriers are each provided with an upper arm 118 and a lower arm 120. These arms are connected to the dividers and positioned between the first and second protrusions 106 and 108 on the dividers. In their neutral orientation, the barriers serve to prevent further forward movement of containers 16' on the gravity fed shelf. In the embodiment illustrated in FIG. 6, the barriers can pivot forward and back in the same manner as café type doors or saloon doors. It should be appreciated that the first and second barriers 112 and 114 cooperate to retard the forward movement of a stacked set of containers 16'. In other words, multiple containers, one atop another, are prevented from moving forward by the cooperating barriers 112 and 114. Put another way, the height of the barriers 112 and 114 is greater than the height of a container 16'. In the design illustrated, the adjacent edges of the barriers or doors are spaced from one another, but they could be close to one another in the neutral position. The barriers can be made of a transparent material so that information on the container would be visible to purchasers.

In another design, the barrier can be so shaped as to only extend the height of a single container, such as the barrier 122. In still another design, a single product barrier, such as at 124, can include a tapered lower surface 126. This allows a consumer to more easily grasp the container 16' by allowing the fingers of the consumer to contact the container without blockage by the barrier. As with the earlier barrier designs, the barrier 124 is biased to a neutral position by a spring 128. The spring 128 can include a leg 130 illustrated in dashed outlines, which can extend along a back side of the barrier.

In still another design, a short front fence 136 can be employed to block further forward movement of a lowermost container 16'. In a yet further embodiment, a pivoting barrier 140, biased by a spring 142 to an upright position, is illustrated. To the far left of FIG. 6 is an illustration of the pivoting barrier 140 in a forwardly pivoted orientation, so as to allow removal of container 16' from the shelf 100.

Figure 7:
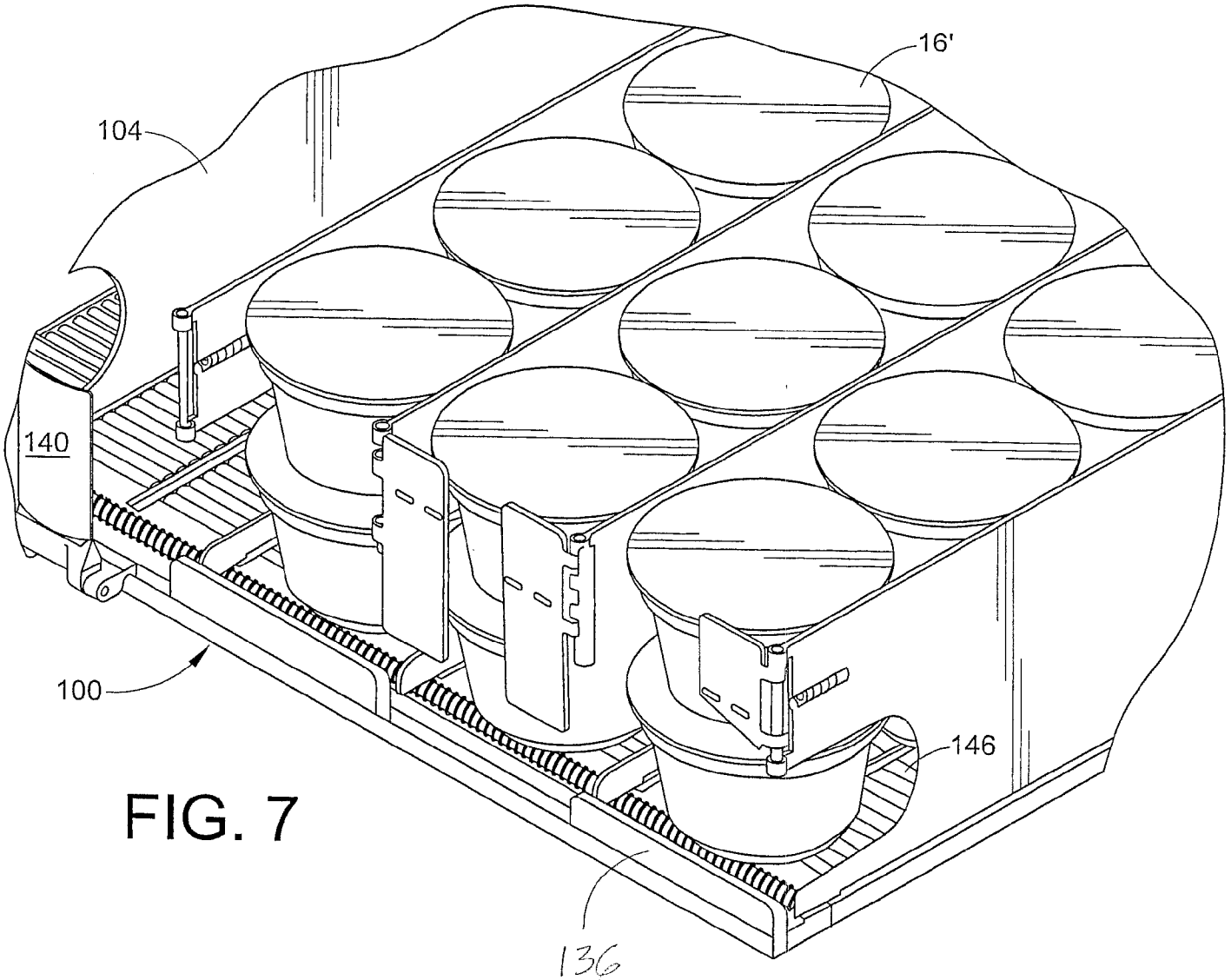
FIG. 7 is a perspective view of a portion of the shelving system of FIG. 6.

FIG. 7 illustrates that the divider 104 can include a slot 146 along its front face. The slot serves to accommodate the fingers of a consumer who wishes to withdraw a container 16' from the shelf 100. When barriers are employed only for an upper column of products, such as on the far right in FIG. 7, then a short front fence 136 becomes useful to retard a lower container 16' from falling off the shelf 100.

With reference now to FIG. 10, disclosed therein is a shelving design in which an auxiliary shelf 150 is mounted on a support shelf 160 that is connected to uprights or standards by a mounting portion 162 including teeth 164. It can be seen that the auxiliary shelf 150 is somewhat shorter than the main shelf 160. While less product can be held on the auxiliary shelf than on the main shelf, the auxiliary shelf is nevertheless advantageous from the standpoint that it can be easily connected to the main shelf or disconnected therefrom as may be necessary. In this way, a merchant can nest more product in the same amount of space without having to remove and reinstall all the shelving for a particular product category.

Figure 11:
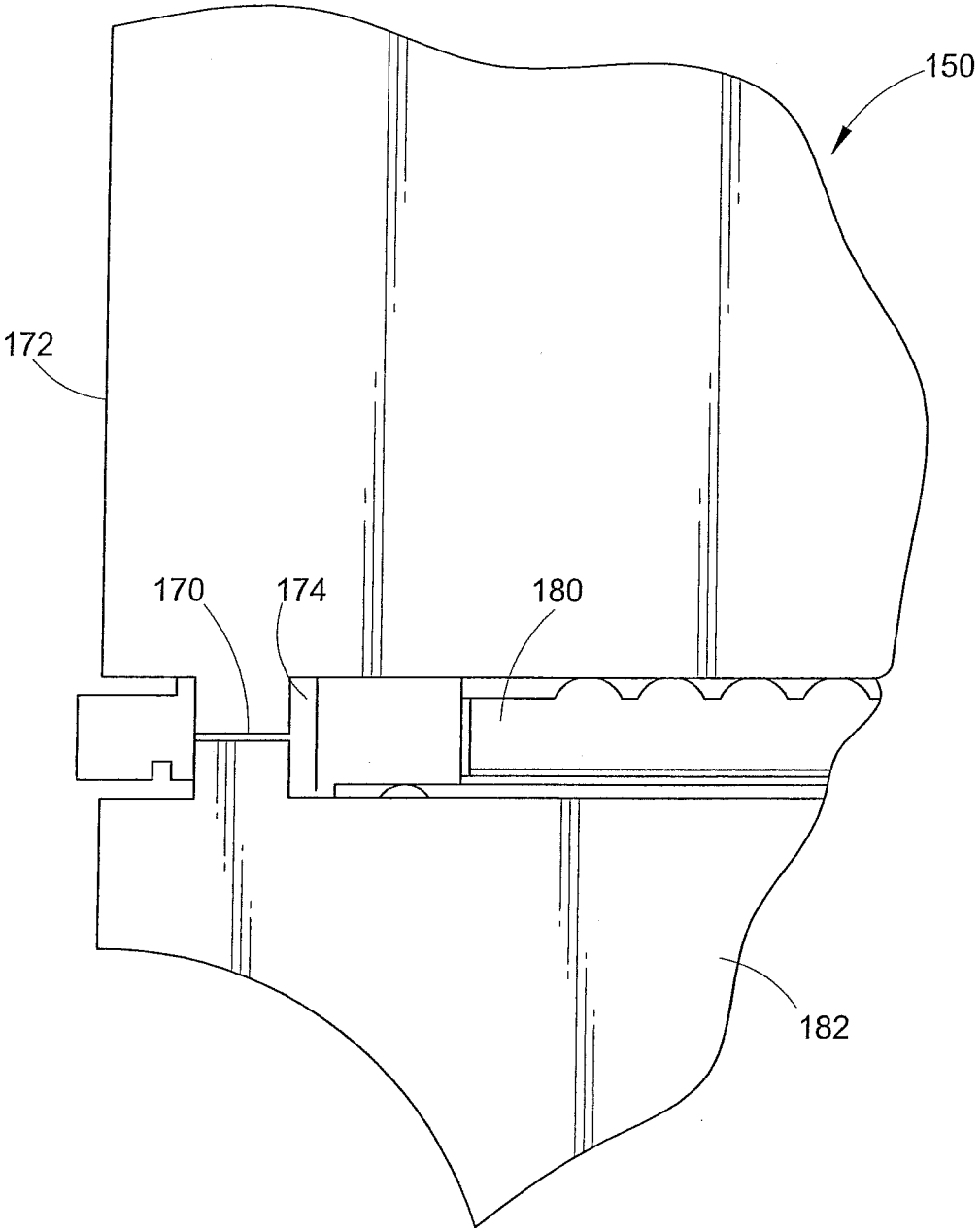
FIG. 11 is a schematic side elevational view of a portion of the shelving system of FIG. 10.

With reference now to FIG. 11, the auxiliary shelf 150 can be mounted via tabs 170 which protrude from a top divider 172. In one embodiment, such tabs extend into a slot 174 which can be provided in a housing of a roller system 180. The roller system can be of the same type as the roller track 14 discussed above. The slots can be provided on or adjacent to side edges of the roller system or roller track housing. Such slots can extend through the roller track housing so as to be accessible from both a top surface and a bottom surface of the track.

Figure 3:
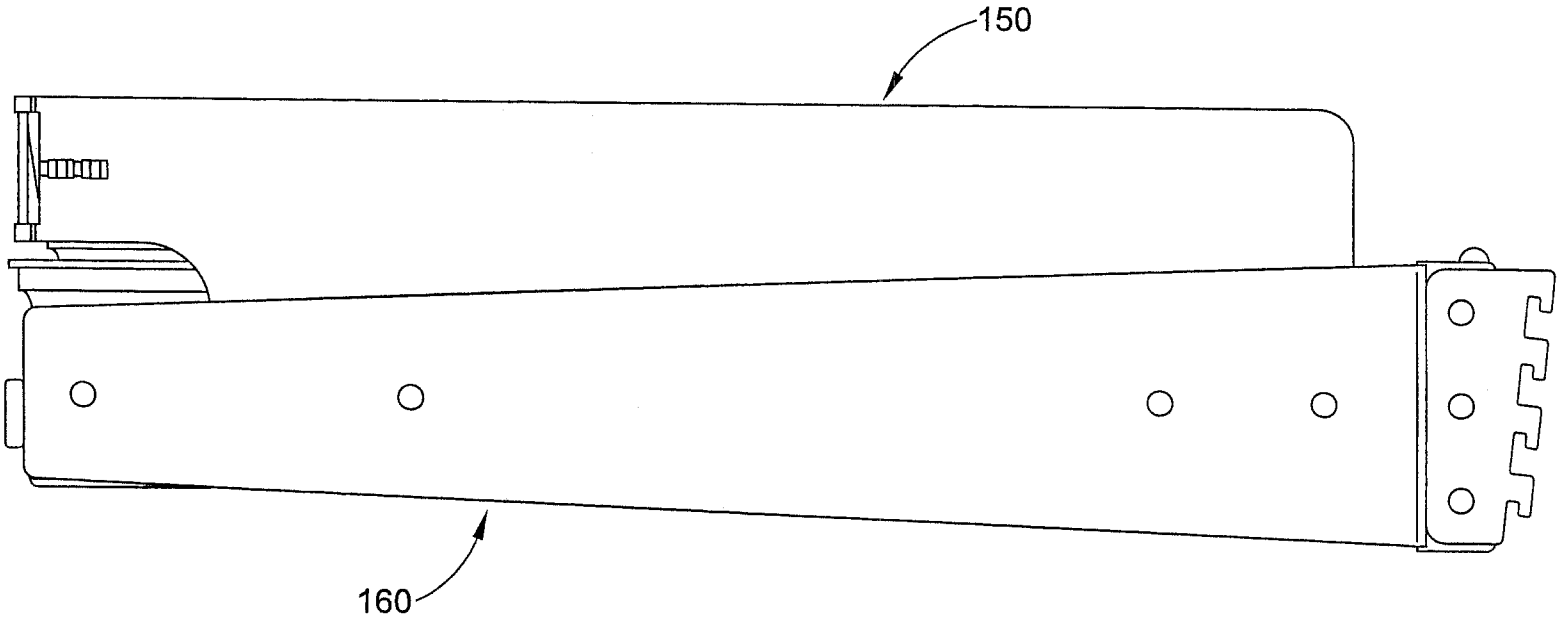
FIG. 3 is a side elevational view of a shelving system according to a second embodiment of the present disclosure in a retracted position.
Figure 4:
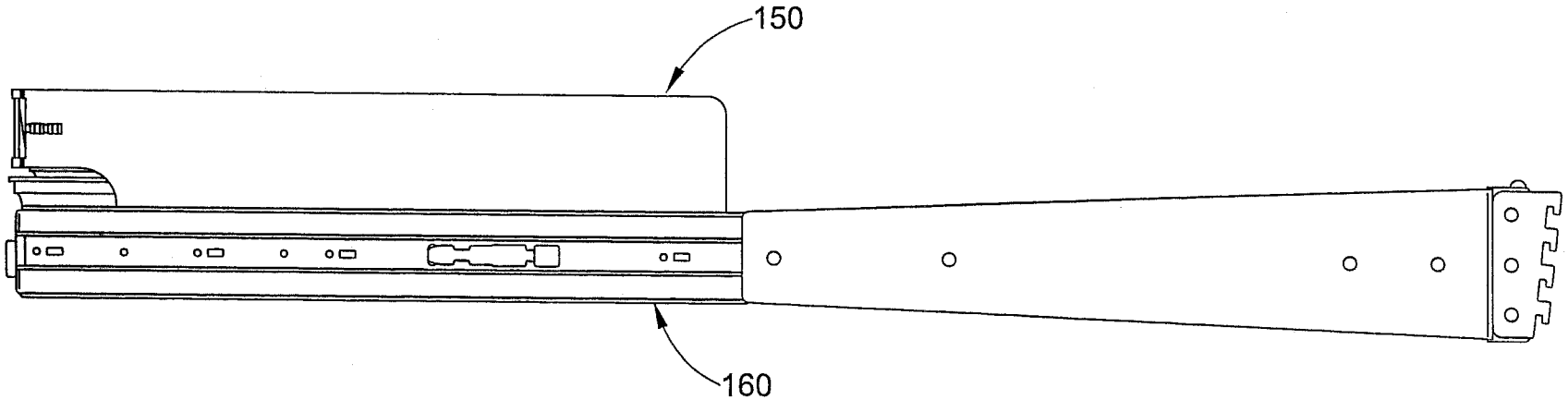
FIG. 4 is a side elevational view of the shelving system of FIG. 3 in an extended position.

The roller system 180 is mounted on a bottom divider 182, also having tabs, via the slots 174. Thus, the auxiliary shelf 150 is comprised of the roller system 180 and respective top dividers 172 located on either side of the roller system 180. One embodiment of this design is also evident from FIGS. 3 and 4.

Figure 13:
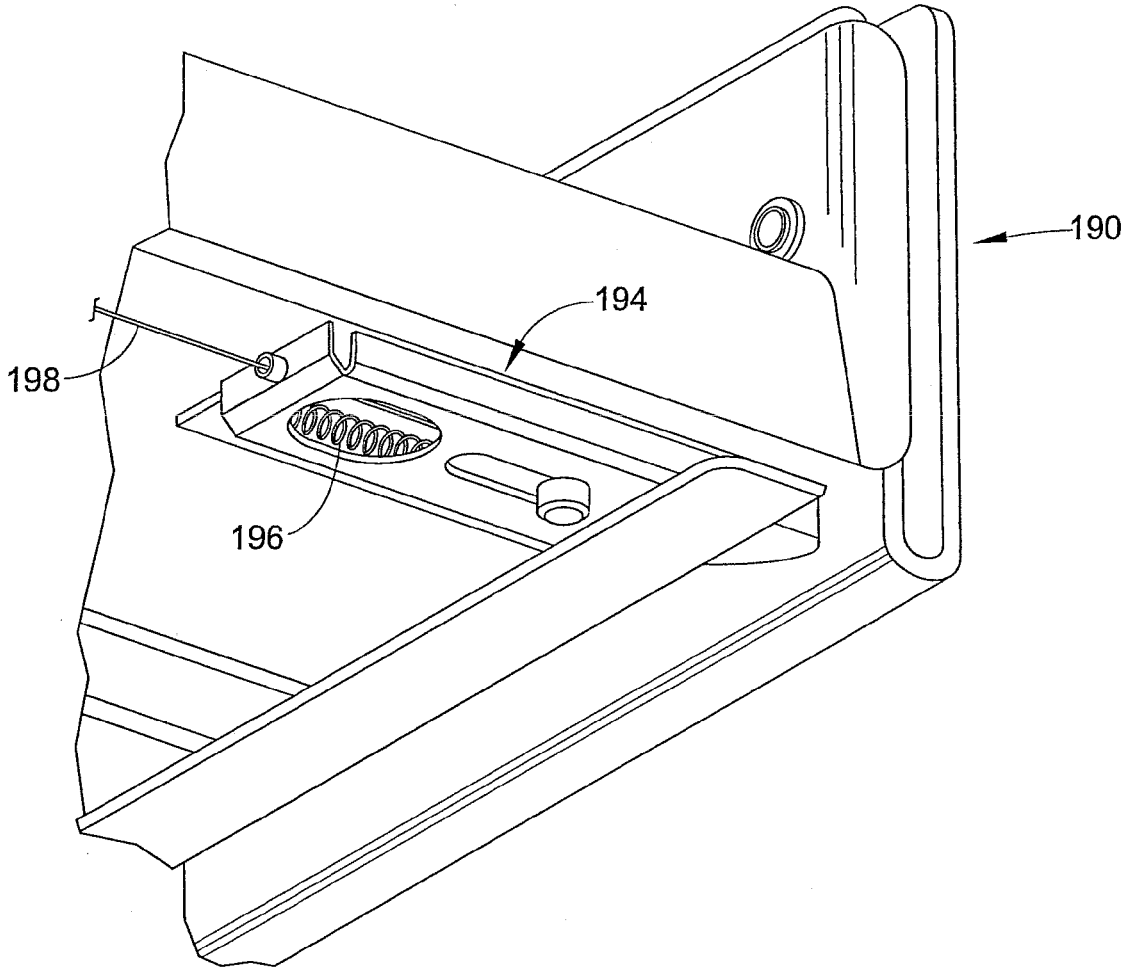
FIG. 13 is a perspective view of a latch system for shelving according to a further embodiment of the present disclosure.

With reference now to FIG. 13, a latch system can be provided for one or more of the types of shelving disclosed herein. In the embodiment illustrated in FIGS. 13-15, a shelf 190 is provided with a latch system 192 (FIG. 15). The latch system includes a latch member 194 which can be positioned adjacent both side edges of the shelf. The respective latch is located adjacent the shelf side wall. As evident from FIG. 13, the latch can be spring biased by a spring 196. It is evident from FIG. 15 that the two latch members 194 are connected via a cable 198 so that they act in unison unlatching the shelf at the same time.

Figure 14:
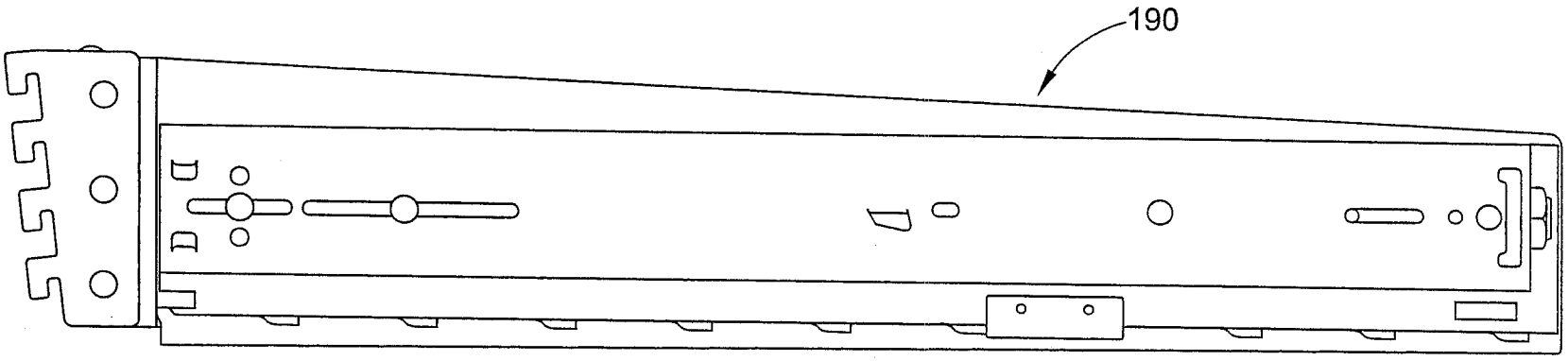
FIG. 14 is a side elevational view of the latch system of FIG. 13.
Figure 15:
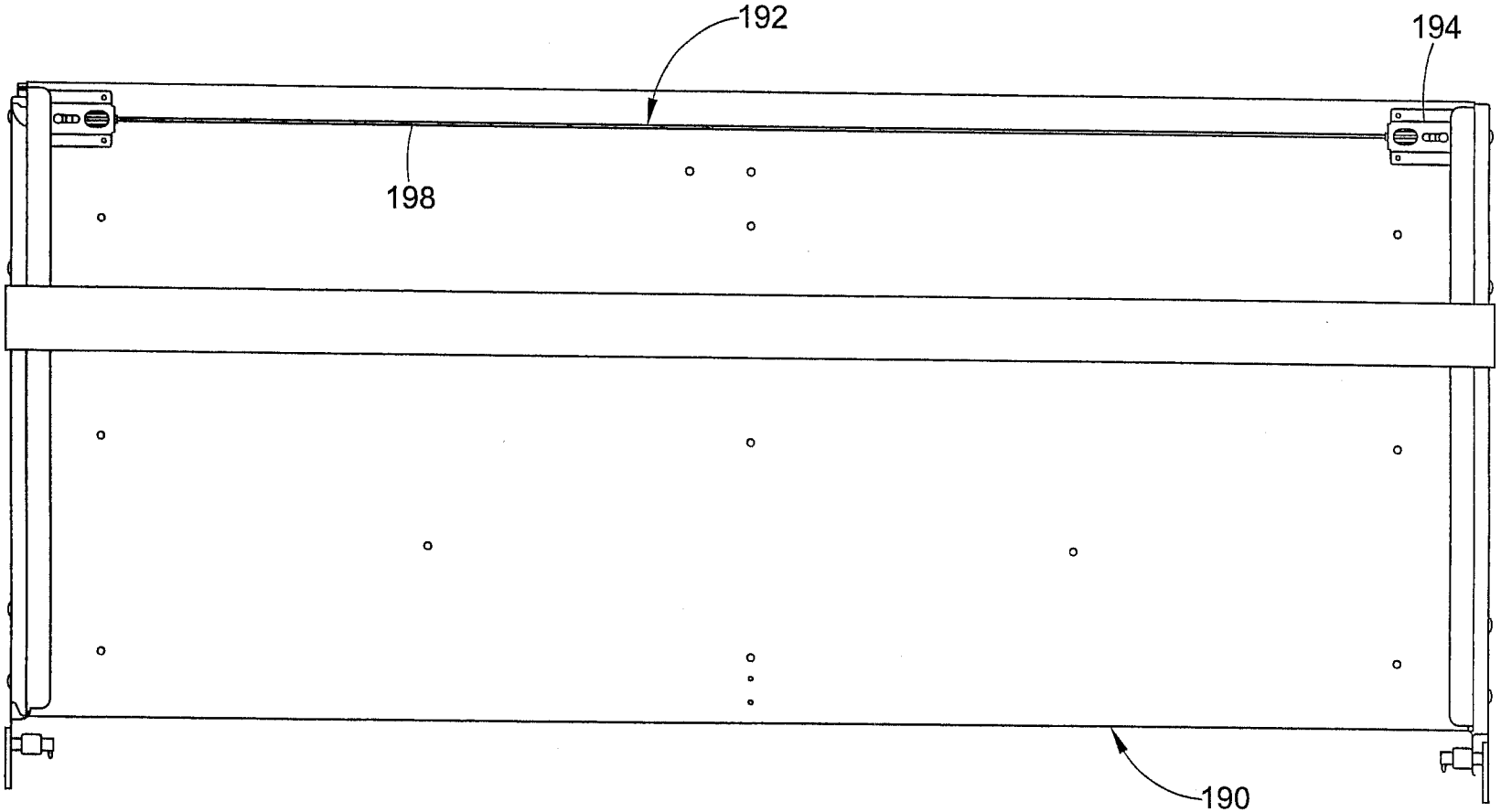
FIG. 15 is a bottom plan view of the latch system of FIG. 13.

With reference now to FIG. 14, the latch mechanism can be provided either adjacent the front end or the rear end of the shelf. It is contemplated that moving the latch towards the rear end of the shelf, i.e., towards the uprights, may be advantageous. An operator would hold the cable or the safety latch in order to slide the shelf forward to a product load configuration. The spring loaded safety latch would engage slots in the first and second brackets to allow the shelf to be slid out from a use configuration to a restocking configuration. When the shelf has been restocked, it is simply pushed back and the spring bias of the latches will again reengage the shelf with the brackets to maintain the shelf in a use configuration.

Figure 16:
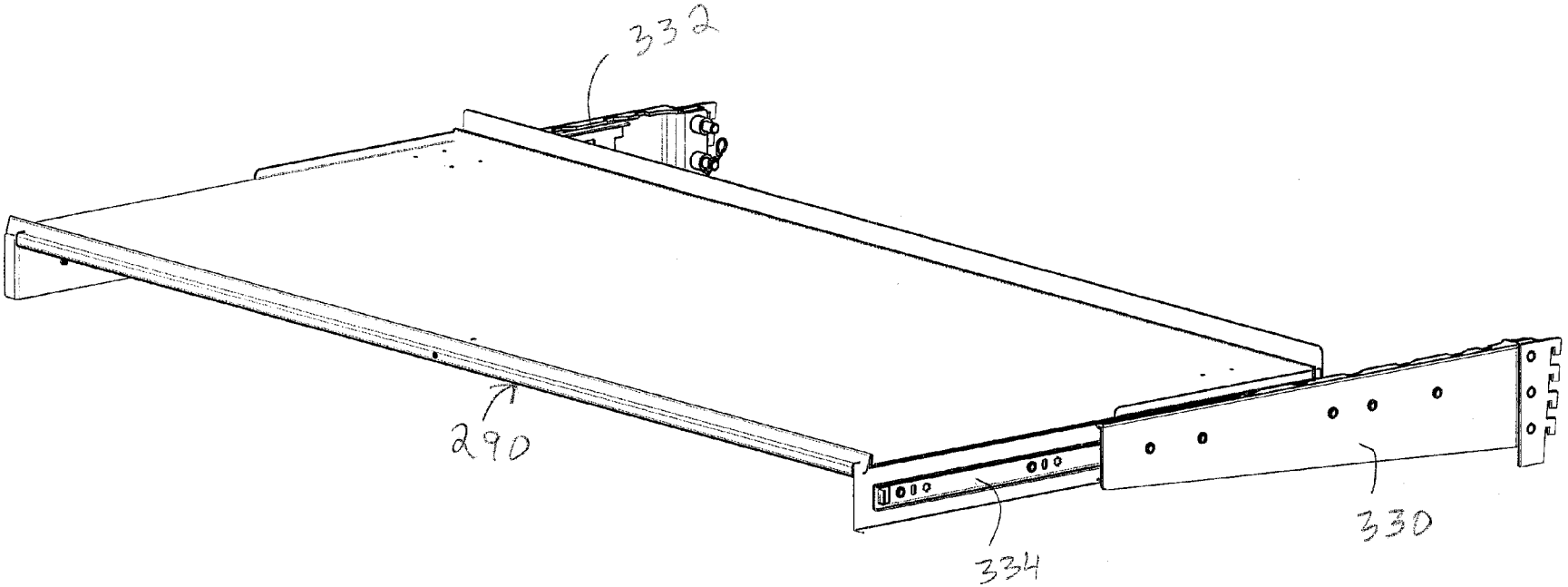
FIG. 16 is a perspective view of a shelving system employing a latch system according to yet another embodiment of the present disclosure.
Figure 17:
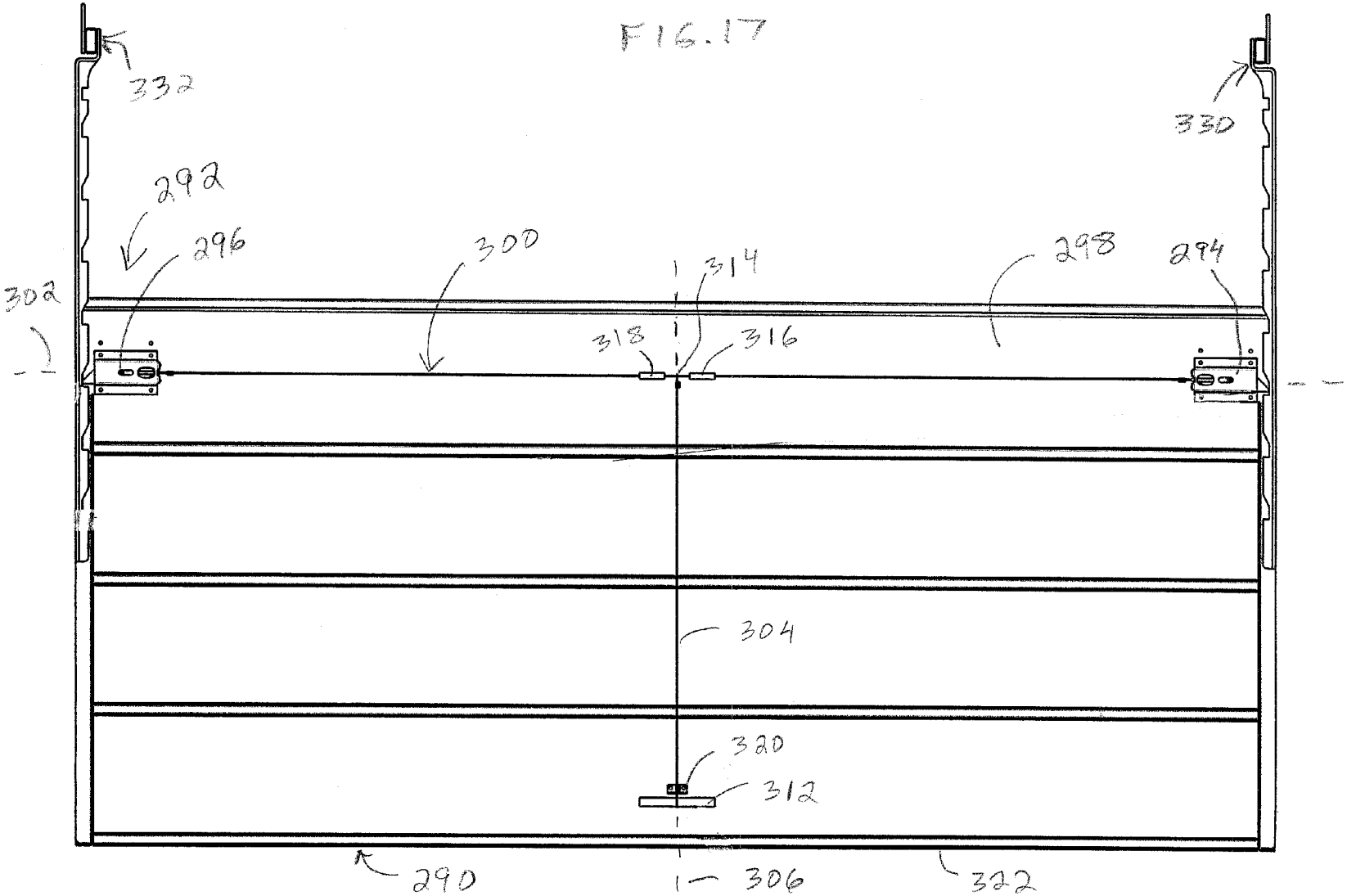
FIG. 17 is a bottom plan view of the shelving system of FIG. 16.

With reference now to FIG. 16, another embodiment of a latch system is employed on a shelf 290. FIG. 17 illustrates a bottom plan view of the shelf and its associated brackets. Disclosed therein is a latch system 292 which comprises a first latch housing 294 located adjacent a first side edge of the shelf 290 and a second latch housing 296 located adjacent a second side edge of the shelf. The latch housings are mounted on an underside 298 of the shelf. Extending between the latch housings is a first cable 300, which can be termed a connecting cable. The first cable extends along a first axis 302 that is oriented sideways or laterally in relation to the shelf such that the first axis extends through the brackets holding the shelf. Also provided is a second cable 304 which is oriented along a second axis 306. The second axis can extend generally perpendicular to the first axis 302. In other words, the second axis 306 extends along a path of movement of the shelf 290 in relation to the brackets on which it is supported.

Positioned adjacent a first end of the second cable 304 is a handle 312. Positioned adjacent a second end of the second cable 304 is a loop 314 defined by the cable. Thus an end of the second cable can be looped around the first cable 300 thereby connecting the two cables to each other. Provided on the first cable are a pair of spaced stops 316 and 318 such that the loop 314 of the second cable is positioned between them. In this way, the angle of orientation of the second cable 304 is prevented from changing significantly in relation to the first cable 300 since the loop is retarded from movement away from a span of the first cable located between the first and second stops 316 and 318. The cables 300 and 304 can be made of suitable materials, such as wire or various fibers.

Provided adjacent the handle 312 is a cable bracket 320 through which the second cable 304 extends. In this way, the second cable 304 is retarded from sagging away from the shelf bottom surface 298 due to the weight of the handle 312. It should be apparent that the lengths of the first and second cables 300 and 304 need to be controlled so that the first cable extends in a generally taut manner between the first and second latch housings 294 and 296, and the latch bolts in them, and that the second cable 304 extends far enough forward to approach a front end 322 of the shelf 290 but yet remains beneath the shelf and short of the front end 322 thereof. In this way, the cable assembly or actuating device is kept out of the way of shoppers so that product can be withdrawn by shoppers from the shelf when the shelf is in the vending position.

As mentioned, the shelf 290 is slidably mounted between a pair of side brackets including first side bracket 330 and a second side bracket 332. Suitable slides, such as slide 334 illustrated in FIG. 16, can be disposed between the brackets 330 and 332 and the shelf 290. In this embodiment, a ratcheting locking mechanism is employed for the shelf 290.

Figure 18:
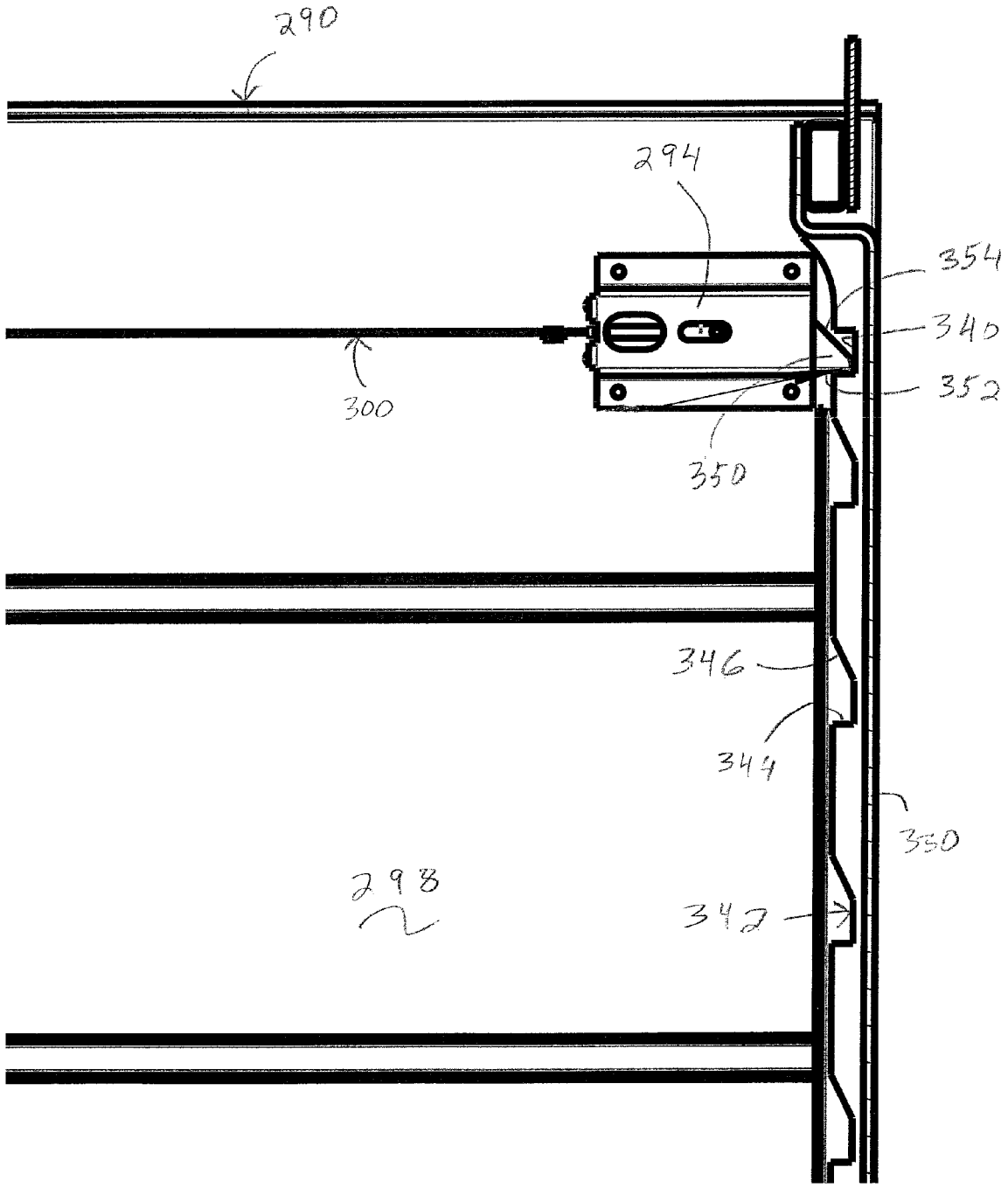
FIG. 18 is an enlarged bottom plan view of a portion of the shelving system illustrated in FIG. 17.

With reference now to FIG. 18, defined on facing surfaces of the two side brackets 330 and 332 are a plurality of slots or catches, i.e. openings defined in the bracket, which cooperate with a respective latch member mounted in the pair of latch housings 294 and 296. Only one of the latch and catch assemblies will be discussed and illustrated in FIG. 18, it being appreciated that the other latch and catch assembly or locking mechanism is a mirror image of the one being described. Defined on the first side bracket 330 are a home slot or catch 340 and a plurality of spaced extension slots or catches 342. Each of the extension slots in this embodiment comprises a flat front face 344 and an angled rear face 346.

Mounted in the latch housing 294 is a resiliently biased (such by a spring, see spring 196 in FIG. 13) latch member 350. The latch member includes a flat front face 352 and an angled rear face 354. This type of latch member is sometimes referred to as a spring-loaded bolt with an angled or beveled edge. It should be appreciated that the flat front face 352 of the latch member contacts the flat front face 344 of each extension slot 342 as well as a similar flat front face of the home slot 340. In this way, the shelf 350 is retarded or prevented from sliding forward in relation to the merchandising apparatus that the shelving system is part of as long as the latch 350 is engaged with one of the catches 340 or 342. While movement in a first direction, namely a forward direction, is retarded or prevented by the engagement of each latch with a catch, a rearward movement of the shelf can be accomplished. When the shelf 290 is urged in a rearward direction, the angled rear face 354 of the latch member 350 contacts the angled rear face 346 of each of the extension slots each latch bolt will retract against the bias of the resilient biasing member into the respective latch housing 294, thus allowing the shelf to be pushed towards the rear. The latches will then engage the next rearwardly located catch and the process can be repeated. In this way, the sliding shelf can be retracted from a stocking position to its vending position. When engaged with a catch, however, the latch bolt prevents or retards a forward movement of the shelf in relation to the side brackets. It is noted that the home catch 340 does not have an angled rear face, unlike the extension catches, as can be seen in FIG. 18.

In one embodiment, the shelf is employed in a gravity feed merchandising system such that the shelf is angled downwardly at an acute angle in relation to a horizontal plane. Thus, the shelf would have a tendency to slide forward in relation to the two brackets 330 and 332 supporting it but for the presence of the latching mechanism. However, when restocking of the shelf is required, this can be accomplished by store personnel simply by pulling the handle 312 attached to the second cable 304 thereby also pulling the first cable 300. Because the first cable is connected to the pair of latch members 350 housed in respective latch housings 292 and 294, each latch member is retracted against the resilient bias of its respective biasing member. Once the flat front faces of the latch members are no longer contacting the flat front face of the catch member they were contacting, the shelf is allowed to slide forward in relation to the brackets from the vending position to one or more stocking or restocking positions as may be required for any particular stocking operation. Subsequently, once stocking has been accomplished, the shelf 290 can be pushed back into the vending position relatively simply due to the ratcheting action of the locking mechanism, namely, the latches and catches illustrated in FIGS. 17 and 18.

The product merchandiser embodiments illustrated herein allow shelving to be stacked closely together as withdrawal of the containers does not involve much upward movement of the containers to clear a barrier. Instead, the containers can be simply withdrawn in a generally horizontal direction. In addition, the provision of auxiliary shelves allows the product density for the merchant to be increased significantly. This is very desirable, as more products can be displayed by the merchant in the same amount of space without having to remove and reinstall shelves.

Further, the product merchandiser designs illustrated herein allow shelving to accommodate the uprights or standards of a variety of manufacturers, thereby enabling the disclosed shelving to be almost universal in nature.

In addition, another benefit of the disclosed shelving designs is that slide out shelving is provided in which the orientation of the shelf does not change during the sliding out procedure so that product held on the back end or inner end of the shelf does not hit or contact the shelf immediately above the one which is being slid forwardly.

A latch system is disclosed herein which enables the slide out shelf to be held in a use or vending configuration. The latch system can be selectively disengaged to allow the shelf to move into a stocking or restocking configuration on slides defined between side walls of the shelf and brackets mounting the shelf to supports or uprights of the store fixtures.

A variety of blocking or retaining members has been disclosed herein for use at the front end or dispensing end of a gravity fed merchandising shelf. In one design, multiple stacked containers can be prevented from forward movement. In another design, single containers in a stack are prevented from such movement.

Disclosed has been a product vending system in the form of a merchandising shelf comprising a support member for supporting at least one associated object for display and/or dispensing. The support member defines a longitudinal pathway along which the associated at least one object can travel from a rear position to a front position. The shelving system can be of a slide out nature so that the shelf can be slid forward for restocking. The shelving system is adaptable for use with the uprights or standards supplied by a variety of manufacturers. Also, the shelving system, which can be a gravity fed system, can include a movable retainer operatively connected to a front end of the shelving system. The retainer is movable from a first position which at least partially obstructs the pathway, thereby retarding forward movement of the at least one associated object beyond the front end of the shelf, to a second position allowing further forward movement of the at least one associate object for removal of same from the shelf. In one embodiment, the retainer can include two cooperating sections which can pivot outwardly to allow product to be removed from the shelf or pivot inwardly to allow product to be restocked on the shelf. In another embodiment, the retainer assembly can retard the movement of at least two stacked containers at the same time. In one embodiment, a bottom wall of the retainers can be tapered so as to allow finger access to product being held on the shelf. A latching system for the pull out shelving is also provided.

The present disclosure has been described with reference to several embodiments. Obviously, modifications and alterations will occur to others upon the reading and understanding of the preceding detailed description. It is intended that the present disclosure be construed as including all such modifications and alterations insofar as they come within the scope of the appended claims or the equivalents thereof.

What is claimed is:

1. A sliding shelf latching system comprising:

a shelf movably mounted on a pair of side brackets, each of the pair of side brackets including a plurality of spaced catches defined thereon, said shelf being movable between a vending position and a stocking position;

a first latch housing mounted to the shelf adjacent a first side edge of the shelf;

a second latch housing mounted to the shelf adjacent a second side edge of the shelf;

a first latch member mounted in the first latch housing, said first latch member being resiliently biased into an extended position by a first biasing member;

a second latch member mounted in the second latch housing, said second latch member being resiliently biased into an extended position by a second biasing member;

wherein said first and second biasing members urge a respective one of said first and second latch members into contact with a respective one of said plurality of catches;

a first cable connecting said first and second latch members to each other;

a second cable connected adjacent a first end thereof to the first cable and including a handle located at a second end thereof, the second cable extending in common direction with the side brackets;

wherein said first and second latch members comprise a flat front face and an angled rear face for engaging with a respective flat front face and an angled rear face of at least one of said plurality of catches in each side bracket; and wherein said first cable is adapted to move said first and second latch members into respective retracted positions and allow said shelf to be moved from the vending position to the stocking position when said second cable is displaced towards a front edge of the shelf from a first position to a second position; and wherein said shelf can be returned from the stocking position to the vending position irrespective of whether the second cable is in the first position or the second position.

2. The system of claim 1 wherein said first latch member comprises a flat front face and an angled rear face.

3. The system of claim 1 wherein at least one of said plurality of catches includes a flat front face and an angled rear face.

4. The system of claim 1 wherein said shelf includes a top surface lying in a plane disposed at an acute angle to a horizontal plane.

5. The system of claim 1 further comprising first and second slides connecting said shelf to said first and second brackets.

6. The system of claim 1 further comprising a second cable connected adjacent a first end thereof to the first cable and including a handle located at a second end thereof.

7. The system of claim 6 wherein the first cable extends along a first axis and said second cable extends along a second axis which is oriented generally normal to the first axis.

8. The system of claim of claim 7 wherein said first axis extends through said pair of side brackets.

9. The system of claim 8 wherein said second axis extends through a front and a rear face of said shelf.

10. The system of claim 6 further comprising a cable bracket mounted to said shelf, said second cable extending through said cable bracket.

11. The system of claim 6 further comprising first and second stops mounted to said first cable in a spaced manner, wherein the first end of said second cable is connected to said first cable at a location between said first and second stops.

12. A sliding shelf latching system comprising:

a shelf including a first side edge, a second side edge, a top surface and a bottom surface, the shelf being slidably mounted between a pair of side brackets and being movable between a vending position and a stocking position, the pair of side brackets including a plurality of spaced catches defined thereon;

a first latch assembly mounted to the shelf bottom surface adjacent the first side edge of the shelf, the first latch assembly including a first latch housing, a first biasing member, and a first latch member resiliently biased to an extended position in relation to the first latch housing;

a second latch assembly mounted to the shelf bottom surface adjacent the second side edge of the shelf, the second latch assembly including a second latch housing, a second biasing member, and a second latch member resiliently biased to an extended position in relation to the second latch housing;

wherein said first and second biasing members urge a respective one of said first and second latch members into contact with one of said plurality of catches;

a first cable connected to said first and second latch members, wherein said first cable is adapted to retract said first and second latch members in order to allow the shelf to be moved from the vending position to the stocking position;

wherein the first and second latch members each have an angled rear surface that interacts with a respective portion of each of the plurality of catches to permit retraction of said first and second latch members independent of the first cable when a force is applied to the shelf to return the shelf to the vending position.

13. The system of claim 12 further comprising a second cable including a first end connected to said first cable and a second end to which is mounted a handle, said second cable extending in a direction generally transverse to a direction of the first cable.

14. The system of claim 12 wherein the shelf is forwardly inclined in relation to a horizontal plane.

15. A latching system for a gravity feed merchandising apparatus, comprising:

a shelf slidably mounted between a first and a second side bracket, the shelf being adapted to move between a vending position and a stocking position, the first and second side brackets each including openings defined on facing surfaces thereof;

a first latch member operably mounted to one of the shelf and the first side bracket, the first latch member including a flat front face and an angled rear face;

a second latch member operably mounted to one of the shelf and the second side bracket, the second latch member including a flat front face and an angled rear face;

wherein the first and second latch members are located adjacent opposed side edges of the shelf;

wherein the first and second latch members are each resiliently biased to an extended position so as to engage the flat front face of a respective one of the first and second latch members with catches defined on the first and second side brackets, thereby retarding said shelf from sliding out of the vending position;

an actuating device for moving the first and second latch members to a respective retracted position thereby allowing said shelf to slide from the vending position to the stocking position, said actuating device including a handle displaceable from a first position corresponding to the extended position of the first and second latch members to a second position corresponding to a retracted position of the first and second latch members, the second position being closer to a front edge of the shelf than the first position;

wherein the angled rear face of the first and second latch member permits a retraction of the first and second latch members against the resiliently biased extended position thereby allowing said shelf to slide from the stocking position towards the vending position; and, wherein said actuating device includes a cable connecting said first and second latch members to each other.

16. The system of claim 15 further comprising a ratchet construction disposed on at least one of the shelf and the first and second side brackets, the ratchet construction being adapted to enable the shelf to be held in a plurality of intermediate positions between the vending position and the stocking position.

17. The system of claim 16 wherein the ratchet construction comprises a first plurality of spaced catches defined on the opening of said first side bracket and a second plurality of spaced catches defined on the opening of said second side bracket, wherein at least one of each of said first plurality of catches and second plurality of catches includes a flat front face and an angled rear face.

* * * * *